US005732422A

United States Patent [19]

McAllister et al.

[11] Patent Number: 5,732,422

[45] Date of Patent: Mar. 31, 1998

[54] COMBINATION HAND SINK AND TRASH RECEPTACLE

[75] Inventors: Larry N. McAllister; Brian C. Powell; Rodney R. Normington, all of Dover, Del.

[73] Assignee: Metal Masters Foodservice Equipment & Co., Inc., Clayton, Del.

[21] Appl. No.: 741,336

[22] Filed: Oct. 29, 1996

[51] Int. Cl.[6] ..... E03C 1/12

[52] U.S. Cl. ..... 4/629; 4/628

[58] Field of Search ..... 4/629, 630, 638, 4/628; 312/228, 229

[56] References Cited

U.S. PATENT DOCUMENTS

| | | | |
|---|---|---|---|
| 1,606,261 | 10/1926 | Hill . | |
| 1,743,187 | 1/1930 | Buckman . | |
| 1,903,623 | 4/1933 | Howe . | |
| 2,130,196 | 9/1938 | Sakier . | |
| 2,353,993 | 7/1944 | Caviccholi | 4/629 |
| 2,524,204 | 10/1950 | O'Brien | 4/629 |
| 3,162,496 | 12/1964 | Morgan | 312/228 |
| 3,240,171 | 3/1966 | Hatch | 312/228 |
| 4,002,382 | 1/1977 | Wolf et al. | 312/228 |
| 4,171,545 | 10/1979 | Kann . | |
| 4,689,840 | 9/1987 | Muck et al. . | |
| 4,813,087 | 3/1989 | Sperka et al. . | |
| 4,847,927 | 7/1989 | Blanc . | |
| 5,073,997 | 12/1991 | Rabe . | |
| 5,199,118 | 4/1993 | Cole et al. | 4/628 |

FOREIGN PATENT DOCUMENTS

| | | | |
|---|---|---|---|
| 396039 | 11/1990 | European Pat. Off. | 4/630 |
| 3624090 | 7/1887 | Germany | 312/228 |
| 2533583 | 2/1976 | Germany | 4/629 |
| 3011303 | 10/1981 | Germany | 4/629 |
| 3842383 | 6/1990 | Germany | 312/228 |
| 107028 | 5/1991 | Japan | 4/630 |
| 1118343 | 10/1984 | Russian Federation | 312/228 |
| 2725525 | 12/1950 | Switzerland | 4/629 |

*Primary Examiner*—Charles R. Eloshway
*Attorney, Agent, or Firm*—Connolly & Hutz

[57] ABSTRACT

A combination hand sink and trash receptacle comprises a hand sink having a horizontal support surface and a wash basin downwardly extending from the support surface. A fixed trash skirt is positioned around the wash basin, and the skirt is secured to the underside of the horizontal support surface. The trash skirt has a front face with a trash opening therein, and a movable trash receptacle is mounted directly under the trash skirt. A horizontal sliding connection between the fixed trash skirt and the movable trash receptacle includes horizontal side flanges on the trash receptacle and horizontal side channels on the trash skirt constructed and arranged to slidingly receive the side flanges on the trash receptacle.

5 Claims, 1 Drawing Sheet

COMBINATION HAND SINK AND TRASH RECEPTACLE

BACKGROUND OF THE INVENTION

The present invention relates to a combination hand sink and trash receptacle, and more particularly to a conveniently and efficiently arranged hand sink and trash receptacle combination.

Over the years many sink constructions have been proposed for use with trash receptacles of one type or another. These receptacles may take the form of separate movable containers located near the sink and/or fixed structures positioned to one side of the sink. In many instances, these fixed structures comprise a paper towel dispenser and a lower trash receptacle. When a plurality of sinks are used with a single fixed towel dispenser and trash receptacle, the fixed structure is inconveniently positioned with respect to all sinks except for the sink directly adjacent the structure. The present invention avoids the disadvantages of the prior art by providing a convenient and efficient hand sink and trash receptacle combination.

SUMMARY OF THE INVENTION

Accordingly, it is an object of the present invention to provide a hand sink with a trash receptacle slidably mounted directly below the sink.

Another object of the present invention is a hand sink and trash receptacle combination which is easy to manufacture, install and use.

Still another object of the present invention is a hand sink and trash receptacle combination where the trash receptacle is easily removed and replaced.

In accordance with the present invention, a combination hand sink and trash receptacle comprises a hand sink having a horizontal support surface and a wash basin downwardly extending from the support surface. A fixed trash skirt is positioned around the wash basin, and the skirt is secured to the underside of the support surface. The trash skirt has a front face with a trash opening therein, and a movable trash receptacle is mounted directly under the trash skirt. A horizontal sliding connection between the fixed trash skirt and the movable trash receptacle includes horizontal side flanges on the trash receptacle and horizontal side channels on the trash skirt constructed and arranged to slidingly receive the side flanges on the trash receptacle.

Preferably, the fixed trash skirt comprises opposite side faces interconnected by the front face with the trash opening. These side faces of the trash skirt include the horizontal side flanges with one flange outwardly extending from each side face. Additionally, in the preferred embodiment of the present invention the trash receptacle has a front face with a handle assembly connected to that face.

The hand sink may include a backsplash secured to the horizontal support surface. Also, a towel and soap dispenser assembly may be positioned directly above the hand sink with the dispenser assembly secured to the backsplash.

BRIEF DESCRIPTION OF THE DRAWINGS

Novel features and advantages of the present invention in addition to those mentioned above will become apparent to persons skilled in the art from a reading of the following detailed description in conjunction with the accompanying drawings wherein similar reference characters refer to similar parts and in which.

DETAILED DESCRIPTION OF THE INVENTION

Figure 4:
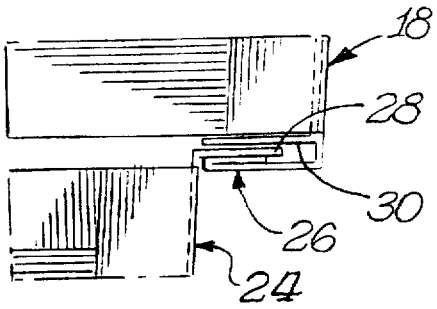
FIG. 4 is a fragmental front elevational view showing the sliding connection between the fixed trash skirt and the movable trash receptacle.
Figure 3:
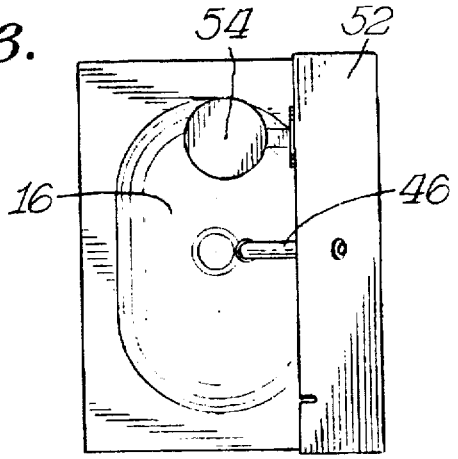
FIG. 3 is a top plan view of the combination hand sink and trash receptacle shown in FIGS. 1 and 2.
Figure 1:
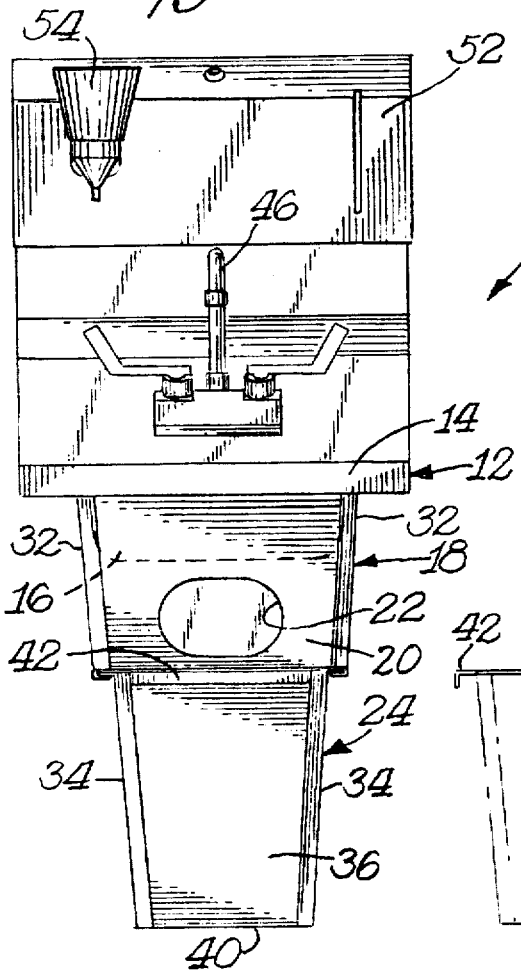
FIG. 1 is a front elevational view of a combination hand sink and trash receptacle, according to the present invention.
Figure 2:
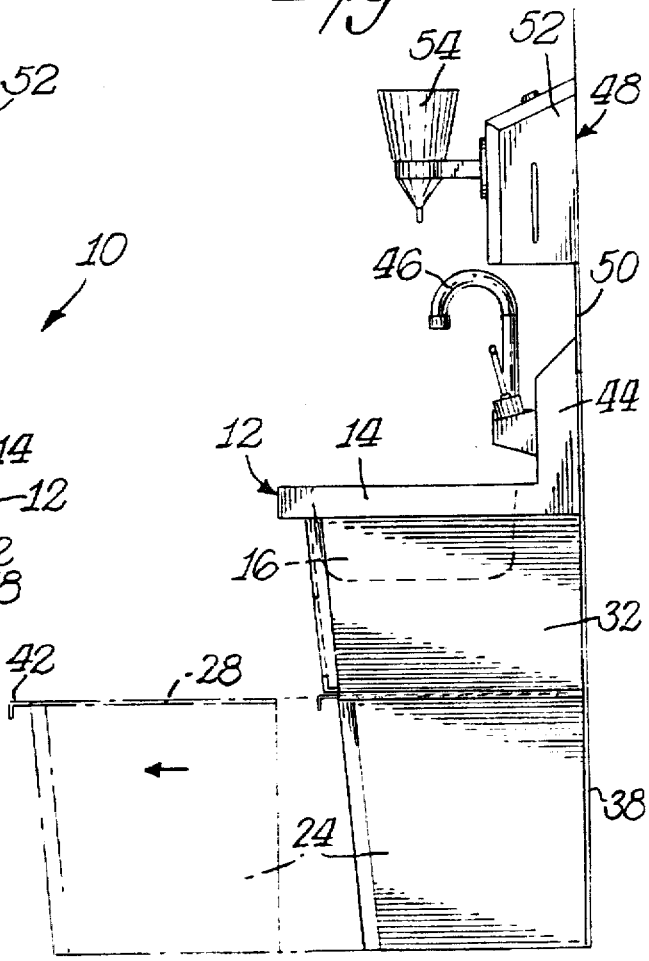
FIG. 2 is a right side elevational view of the combination hand sink and trash receptacle shown in FIG. 1 also illustrating a withdrawn trash receptacle in phantom outline.

Referring in more particularly to the drawings, FIGS. 1–4 illustrate a combination hand sink and trash receptacle 10. The combination includes a hand sink 12 having a horizontally disposed support surface 14 and a wash basin 16 downwardly extending from the support surface. A fixed trash skirt 18 is positioned around the wash basin and the skirt is secured to the underside of support surface 14. As shown best in FIG. 1, the trash skirt has a front face 20 with a trash opening 22 therein.

A movable trash receptacle 24 is mounted directly under trash skirt 18. A horizontal sliding connection 26 is arranged between the trash skirt and the trash receptacle, as shown best in FIG. 4. The horizontal sliding connection includes horizontally extending side flanges 28 on the trash receptacle and horizontal side channels 30 on the trash skirt constructed and arranged to slidingly receive the side flanges on the trash receptacle.

The fixed trash skirt and the movable trash receptacle are preferably fabricated from sheet metal material. Moreover, the upper portion of the trash skirt may include a peripheral flange for attachment to the underside of support surface 14 by screw-type fasteners and the like. Additionally, the various shapes and contours of the trash skirt and the trash receptacle may be formed by sheet bending and welding techniques well known in the art.

The trash skirt preferably comprises a three-sided assembly with opposite side faces 32 interconnected by front face 20 with trash opening 22 therein. Moreover, as best shown in FIG. 4, the side faces of the trash skirt include the horizontal side channels 30 of sliding connection 26. One side channel is positioned along the lower edge portion of each side face 32.

Trash receptacle 24 primarily comprises a four-sided construction having opposite sides 34, front face 36, rear face 38 and bottom wall 40. The front face has a handle 42 in the form of a down-turned edge portion extending across the top of the front face, as shown best in FIG. 1.

Hand sink 12 also includes a backsplash 44 connected to horizontal support surface 14. A faucet set 46 is conveniently anchored to the backsplash, and water service lines are connected to the faucet set as is well known.

A towel and soap dispenser assembly 48 may be positioned above sink basin 12 for use in combination with the sink. Assembly 48 has a downwardly extending plate 50 which may be secured to backsplash 44 by any convenient fastening technique. Moreover, assembly 48 specifically includes a towel dispenser 52 and a soap dispenser 54.

Trash items such as spent paper towels and the like are deposited in trash receptacle 24 by dropping these items into and through trash opening 22 in the skirt. Emptying the trash receptacle of its contents is easily accomplished by grasping handling 42 and pulling the trash receptacle in a forward direction. Side flanges 28 on the receptacle slide in the channels 30 of sliding connection 26 until the flanges clear the side channels. The trash receptacle is then emptied and replaced under the trash skirt by reversing this procedure.

What is claimed is:

1. A combination hand sink and trash receptacle comprising a hand sink including a horizontal support surface spaced above a floor and a wash basin downwardly extending from the support surface, a fixed trash skirt surrounding the wash basin and secured to an underside of the support surface, the trash skirt extending downwardly from the underside of the support surface and terminating at a predetermined height above the floor, the trash skirt having a front face with a trash opening therein, a movable trash receptacle mounted directly under the trash skirt, and a horizontal sliding connection between the trash skirt and the trash receptacle including horizontal side flanges on the trash receptacle and horizontal side channels on opposed terminal edges of the trash skirt constructed and arranged to slidingly receive the side flanges on the trash receptacle such that the trash receptacle is suspended above the floor.

2. A combination hand sink and trash receptacle as in claim 1 wherein the trash receptacle has a given side-to-side dimension and the trash skirt comprises opposite side faces spaced apart by the side-to-side dimension of the trash receptacle, and wherein the opposite side faces of the trash skirt are interconnected by the front face with the trash opening.

3. A combination hand sink and trash receptacle as in claim 2 wherein the side faces of the trash skirt include the horizontal side channels of the sliding connection, one side channel along the terminal edge of each side face.

4. A combination hand sink and trash receptacle as in claim 1 wherein the trash receptacle includes a front face and a handle connected to the front face.

5. A combination hand sink and trash receptacle as in claim 1 wherein the hand sink includes a backsplash connected to the horizontal support surface, and a towel and soap dispenser assembly positioned above the wash basin secured to the backsplash of the hand sink.

* * * * *